United States Patent [19]

Chang

[11] 4,433,545

[45] Feb. 28, 1984

[54] THERMAL POWER PLANTS AND HEAT EXCHANGERS FOR USE THEREWITH

[76] Inventor: Yan P. Chang, 181 Sherbrooke Ave., Williamsville, N.Y. 14221

[21] Appl. No.: 399,463

[22] Filed: Jul. 19, 1982

[51] Int. Cl.[3] ..... F01K 7/34

[52] U.S. Cl. ..... 60/678; 60/677; 60/679; 165/110; 165/154; 165/166

[58] Field of Search ..... 60/653, 677, 678, 679, 60/680; 165/110, 154, 166

[56] References Cited

U.S. PATENT DOCUMENTS 1,132,456 3/1915 De Ferranti ..... 60/679
1,970,169 8/1934 Godward ..... 165/110 X

FOREIGN PATENT DOCUMENTS 316804 8/1929 United Kingdom ..... 60/679

*Primary Examiner*—Allen M. Ostrager

*Assistant Examiner*—Stephen F. Husar

*Attorney, Agent, or Firm*—Allen J. Jaffe

[57] ABSTRACT

A thermal power plant having multi-staged steam turbines and heat exchangers therebetween, each heat exchanger extracting heat from the supply to an upstream stage for adding heat to the supply of the next successive downstream stage; a portion of the supply to the last downstream stage being diverted through a heater for adding heat to the feedwater flow to a boiler. Additional heat exchangers may be provided between stages for utilizing the feedwater to cool the working steam. One form of heat exchanger is provided with a plurality of axially spaced annular chambers having vortex flow producing means adjacent the inner peripheries thereof; whereas another form of heat exchanger is provided with a helically finned interior chamber in fluid communication with upstream guide vanes for inducing vortex flow.

14 Claims, 8 Drawing Figures

Fig. 6.
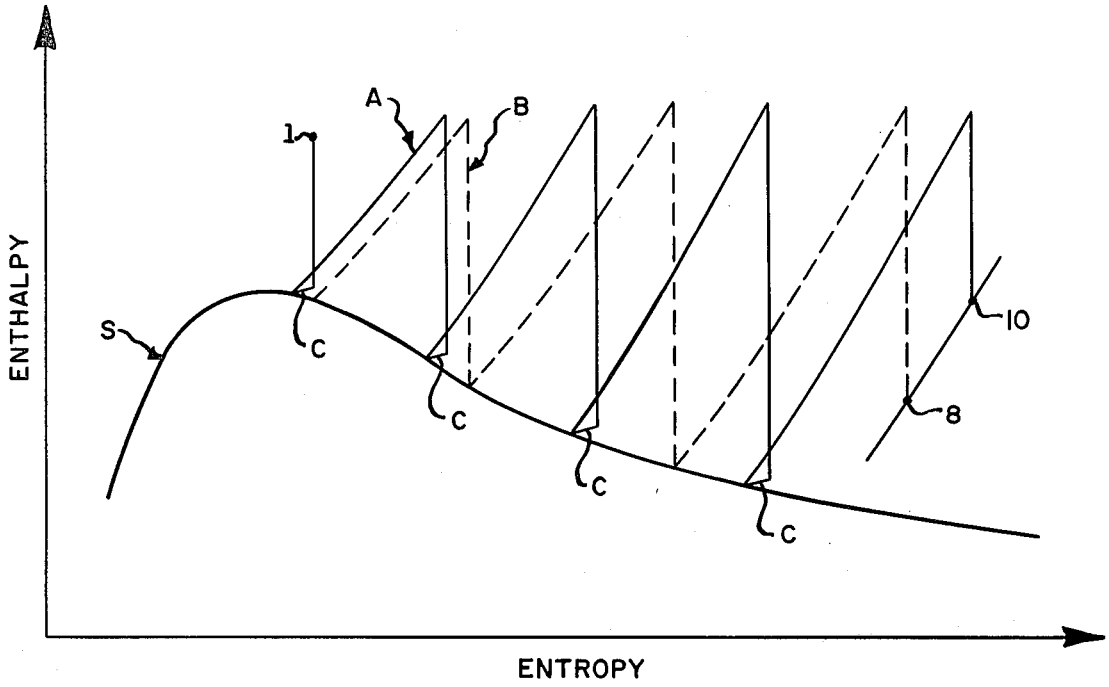
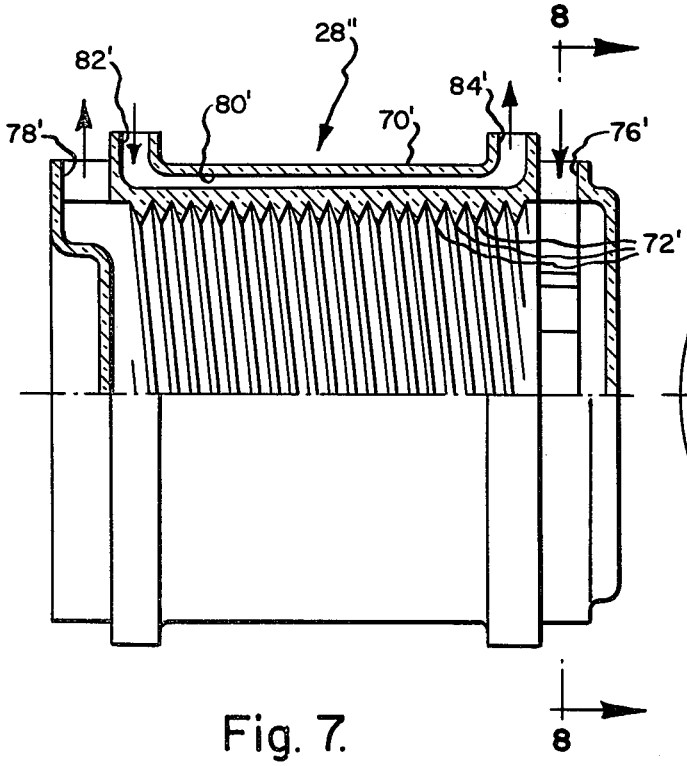
Fig. 7.
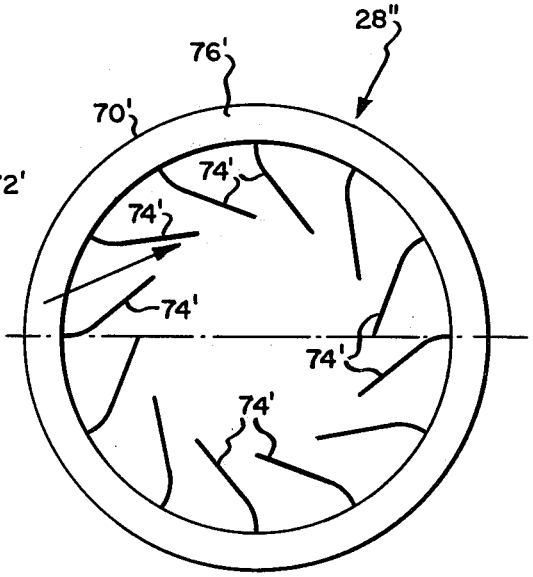
Fig. 8.

THERMAL POWER PLANTS AND HEAT EXCHANGERS FOR USE THEREWITH

BACKGROUND OF THE INVENTION

The present invention relates to thermal power plants and heat exchangers adapted for use in conjunction therewith.

Presently known steam power plants employing a plurality of turbine stages lose more than half of the heat input to the environment through the condenser. Various attempts have been made to increase the efficiency of steam turbine power plants but none have been successful in minimizing the above-noted heat loss to the greatest possible extent.

For example, in prior U.S. Pat. No. 3,992,884 a system is disclosed wherein a portion of the steam produced at low pressure, in a nuclear power plant, is compressed and employed for superheating the steam applied to one or more stages of a steam turbine. The stated improvement in efficiency in such prior system is only substantially 1.5 to 2.5%.

SUMMARY OF THE INVENTION

The foregoing problems of the prior art, as well as other problems not specifically mentioned, are overcome according to the teachings of the present invention which provides a steam turbine power plant and heat exchangers for use therewith that combine to obtain efficiencies not heretofore realized.

According to the teachings of the present invention, a reduction of the aforementioned heat loss, for low temperature and moderate pressure steam, is achieved by; extracting a part of the inlet steam to the first stage of a multi-stage turbine, which extracted steam is employed to heat the outlet steam therefrom or the inlet steam to the second stage; extracting a part of the inlet steam to the second stage and using the same to heat the outlet steam therefrom or the inlet steam to the third stage; and so on for each subsequent stage. The extracted steam prior to the last stage is condensed and pumped to the boiler or steam generating means. Condensate of the condenser can also be used for condensing a part of the working steam.

With the foregoing arrangement, the steam to be condensed in the condenser is reduced as much as possible and, thus, the energy losses therethrough are substantially minimized, as will become apparent hereinbelow.

According to another aspect of the present invention, there is provided a modified steam turbine power plant which is generally similar to that mentioned above but which employs means to remove a small portion of the heat from the steam at the outlet of each stage by means of a unique heat exchanger whereby at the end of each expansion process, the working steam is cooled at a rapidly decelerating or compression flow by water which is drawn from the feedwater line at the position where the water temperature is lower than the working steam. This modification lends itself to high initial temperature and pressure power plants and permits realization of higher efficiencies, as will become apparent herein below.

Other characterizing features and advantages of the present invention will become apparent from the detailed description thereof to follow.

BRIEF DESCRIPTION OF THE DRAWINGS

For a fuller understanding of the present invention reference should now be made to the following detailed description thereof taken in conjunction with the accompanying drawings, wherein:

FIG. 6 is an enthalpy-entropy diagram comparing the systems of FIGS. 1 and 2;

FIG. 7 is an elevational view, partly in section, of a modified heat exchanger for the purpose of heating the working fluid; and FIG. 8 is a view taken substantially along line 8—8 of FIG. 7.

DETAILED DESCRIPTION OF THE PREFERRED EMBODIMENTS

Figure 1:
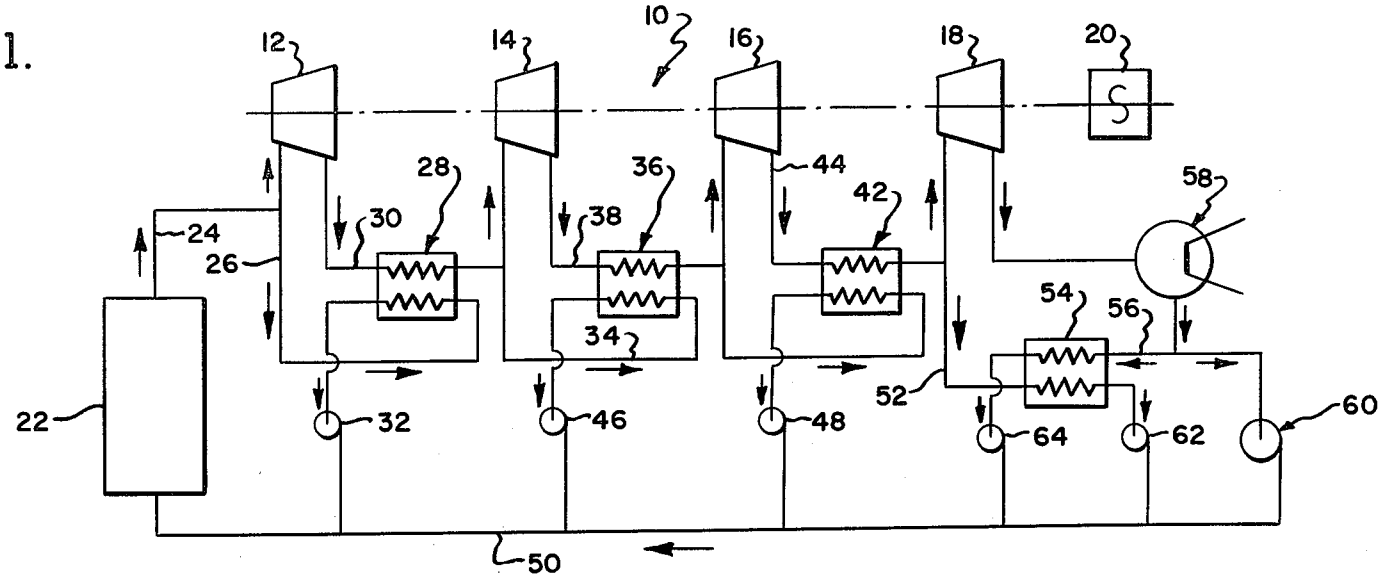
FIG. 1 is a schematic view of the thermal power plant, for low initial temperature and moderate pressure of the working fluid, according to the present invention.

Referring in detail to the drawings and, more particularly, to FIG. 1, the thermal power plant according to the invention is generally depicted at 10 and is shown as including a plurality of tubine stages 12, 14, 16 and 18 which may be employed to drive a generator or the like 20. In the case of steam as the working fluid, suitable steam generating means in the form of a boiler 22 delivers the same via line 24 to the inlet of first turbine stage 12. An extraction or by-pass line 26 (branching from line 24) diverts a portion of the steam through a first heat exchanger, generally depicted at 28, which diverted steam is used to heat the outlet steam in line 30 from first stage 12 and thence condensed and returned to the feedwater line for boiler 22 by suitable pumping means 32. Similarly, a portion of the steam in line 30 is diverted from the inlet of the second stage 14 via line 34 and is fed through a second heat exchanger 36, which portion is used to heat the outlet steam, in line 38, from the second turbine stage which is the inlet to the third turbine stage 16. Again, a portion of the steam in line 38 is diverted via line 40 through a third heat exchanger 42 for heating the outlet steam from stage 16 in line 44 prior to its being fed to the inlet of the fourth stage 18. The condensate of the diverted steam from heat exchangers 36 and 42 may be, similarly, delivered to the feedwater for boiler 22 by pumps 46 and 48, respectively, via feedwater line 50. A portion of the inlet steam for fourth stage 18 may be diverted via line 52 to a feedwater heater 54 for heating a portion of the codensate (in line 56) from a condenser 58. The remainder of the condensed steam is pumped back to boiler 22 by pumping means 60 as is the outlet flow from feedwater heater 54 by pumping means 62 and 64. It should, thus, be apparent that the extraction of steam upstream of each stage for the purpose of heating the steam supplied to the immediate downstream stage will minimize the amount of steam to be condensed by condenser 58 and, thereby, significantly reduce the heat losses associated with the condenser.

As a quantitative example, the following assumptions are made:

1. Steam is supplied from the boiler 22 at a pressure of 45 psi and at a temperature of 274.56 degrees F.;
2. Steam is discharged from the condenser at a pressure of 0.51 psi and a temperature of 79.56 degrees F.;
3. The interstage heat exchangers 28, 36 and 42 heat the working steam to a temperature of 15 degrees below the extracted or diverted steam passing, respectively, therethrough; and
4. The quality of steam at the end of each expansion is kept at 92%.

With these conditions it has been determined that the thermal efficiency of the FIG. 1 system it 25.6%, which is less than 1.0% below that of the conceptual Carnot cycle.

In determining the above efficiency, the standard assumptions are made for comparing thermodynamic efficiencies of different power cycles. Namely, isentropic steam expansion in the turbine stages; negligibly small change in kinetic energy in comparison with the change in enthalpy between any two states; approximate one-dimensional flow and heat transfer; and the heat exchangers are of the counter-flow, tube-cell type.

Although the number of turbine stages and the number of interstage heat exchangers of the FIG. 1 system should be taken as illustrative, it is significant to note that the thermodynamic efficiency thereof can be almost equal to that of the conceptual Carnot cycle with the employment of only three interstage heat exchangers.

Further, it has been found that increasing the initial steam temperature and pressure increases the efficiency of the above-noted extraction heating cycle of FIG. 1, but the same also increases the difference below the corresponding Carnot efficiency. Moreover, the wetter the steam at the end of each expansion, the higher the efficiency and the less is its value below that of the Carnot cycle. It has also been found that the efficiency increases by the provision of additional feedwater heaters between turbine stages. As a quantitative example with the same assumptions as those in the previous example except that the initial temperature and pressure of the steam are 600 degrees F. and 800 psi, respectively, and each expansion of the working steam ends at the saturation curve. For this case, the calculated thermodynamic efficiency is 44.65% which is 2.35% less than that of the Carnot cycle.

Figure 2:
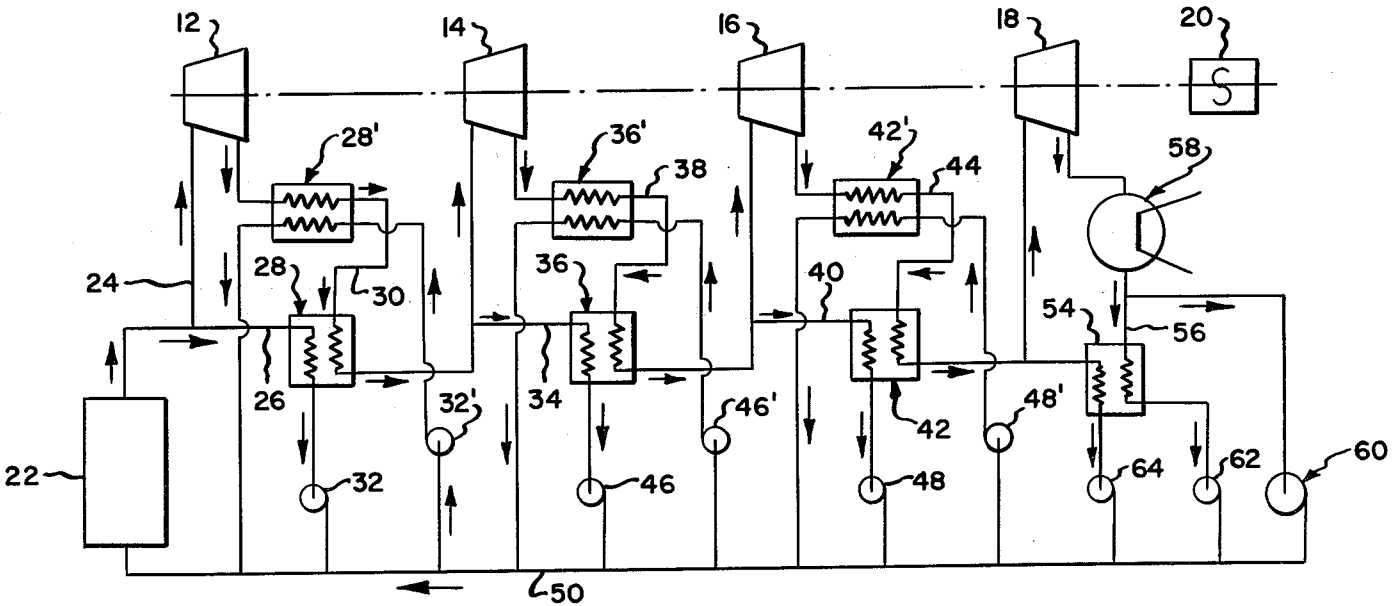
FIG. 2 is a schematic view of a modified power plant for high initial temperature and pressure of the working fluid.

In this regard, reference should now be had to the modification of FIG. 2 wherein like reference numerals are used to depict structure corresponding to that of FIG. 1. It can be seen that the system of FIG. 2 is generally similar to that of FIG. 1 except that means are provided between the turbine stages to remove or extract a small amount of heat from the exhaust of each stage. Such means are depticted as heat exchangers 28', 36' and 42' and are severally located to provide the exhaust of each turbine stage 12, 14, 16 in heat exchange relation with the condensate feedwater in line 50. Suitable pumps 32', 46' and 48' are provided to increase the head of such condensate for passage through such additional heat exchangers 28', 36' and 42', respectively. The system of FIG. 2 finds particularly advantageous application in cycles having high initial temperature and pressure of, for example, 300 to 1000 degrees F. and 100 to 1200 psi. In fact, it has been determined that efficiencies almost equal to that of the Carnot cycle are attainable by using four or five heat exchangers like 28, 36, 42 and 28', 36' and 42' as the practical maximum. However, the working steam has to be dry in all stages.

Figure 5:
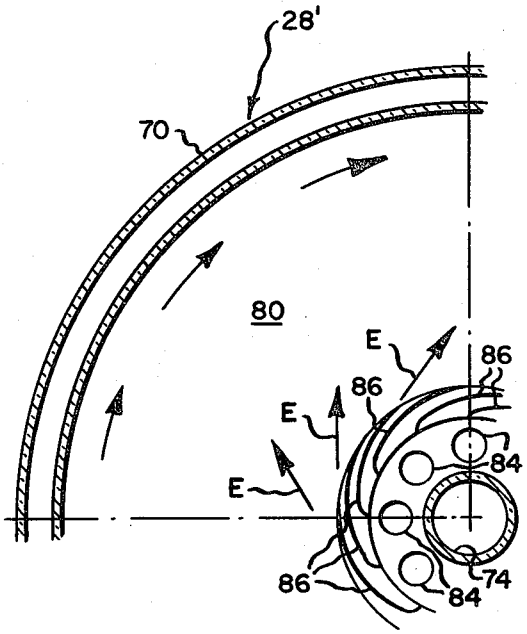
FIG. 5 is a fragmentary sectional view taken substantially along line 5—5 of FIG. 3.
Figure 4:
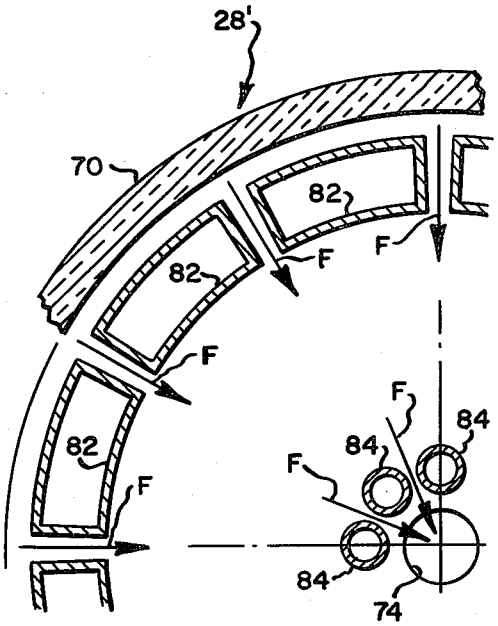
FIG. 4 is a fragmentary sectional view taken substantially along line 4—4 of FIG. 3.
Figure 3:
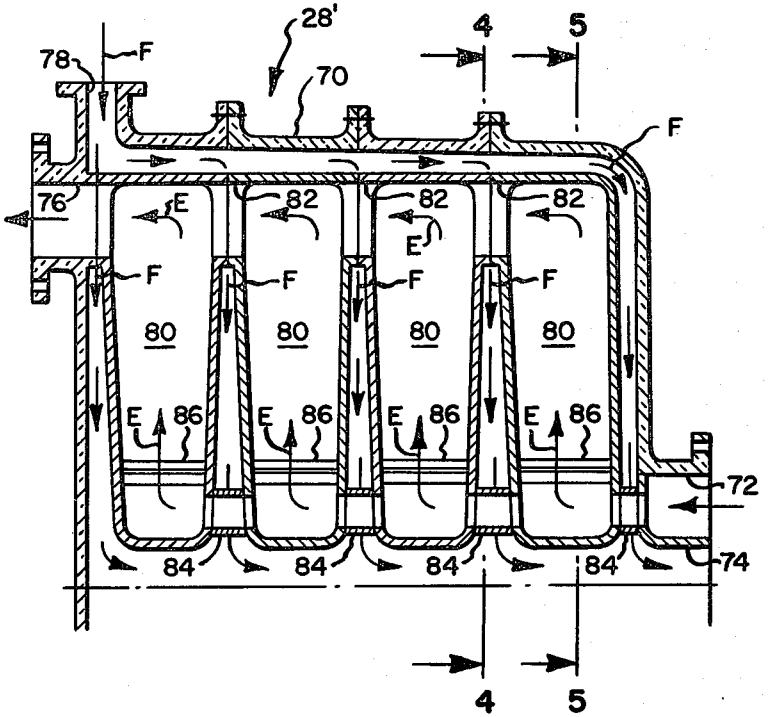
FIG. 3 is a fragmentary cross-sectional view of one form of heat exchanger of the invention that may be advantageously employed in combination with the system of FIG. 2.

One specific embodiment of heat exchangers 28', 36' and 42' is schematically illustrated in FIGS. 3–5 as comprising a generally cylindrical housing 70 which is substantially symmetrical about longitudinal centerline C. Housing 70 is provided at one end with an annular working steam inlet 72 which is concentric to a central axial water or condensate outlet 74. The opposite end of housing 70 is provided with a pair of steam outlets 76 (only one of which is illustrated) and a water or condensate inlet 78. The interior of housing 70 is defined by a plurality of generally annular and axially spaced steam chambers 80 which are in outer peripheral communication with each other by means of circularly arrayed conduits 82; the chamber 80 located adjacent passages 76 being in communication with steam outlet 76. At their radially inner ends and in axial alignment with steam inlet 72, the chambers 80 are in fluid communication with each other by means of a plurality of connecting passages 84 which are circularly arrayed about water outlet passage 74. As more clearly seen in FIG. 5, vortex flow generating means in the form of a plurality of tangentially arranged vanes 86 are provided at the radially inner portions of each chamber 80 in substantial axial alignment with connecting passages 84. The space between the vanes converge tangentially to thereby define nozzle passages which produce a spiral vortex flow pattern of the steam in the directions of arrows E, as the steam passes into each chamber 80. It, thus, should be apparent that working steam enters housing 70 and develops a vortex flow through vanes 86, which greatly increases the pressure of the steam as it leaves through outlets 76. Condensed water enters at 78, flows in heat exchange relation around chambers 80 and connecting passages 82, 84 (in the direction of arrows F) and leaves via outlet 74 after the same has cooled the working steam. This water at 74 may then be pumped to the boiler 22. The above-described heat exchanger, which may be termed a "source-vortex flow coller," is compact in size, effective in heat transfer and is relatively inexpensive to manufacture.

A comparison between the enthalpy-entropy diagrams of the FIGS. 1 and 2 systems is shown in FIG. 6 wherein the solid-line curve A represents the system of FIG. 2; the broken-line curve B represents the system of FIG. 1; and the steam saturation curve is depicted at S. It can be seen that for a given initial state 1 and a given condenser pressure 8, 10, the cycle of FIG. 2 permits a greater amount of steam to be extracted and, thus, the steam to be condensed in the condenser is markedly reduced. Due to the compression flow, the temperature of the working steam drops very slowly in the cooling process which is depicted at C in FIG. 6.

In practice it has been found that constant pressure flow is not obtainable in a conventional heat exchanger (such as the tube-cell type) because of the flow friction. Thus, for less pressure drop, for more cmpact design and for more efficient heat transfer it should be understood that the heat exchanger of FIGS. 3–5 can also be employed in the system of FIGS. 1 and 2 in place of conventional tube-cell type heat exchangers for heating the working steam. In which case, the extracted steam would be supplied to inlet 78 (FIGS. 3–5) and the condensate therefrom would exit at 74.

A more preferred form of heat exchanger, for heating the working steam, however, is schematically illustrated at 28" in FIGS. 7 and 8. In this embodiment an internal chamber in housing 70' is formed by a plurality of helical fins 72' which are fed, at one end of the housing, by a plurality of circularly arranged and radially inwardly directed convergent guide vanes 74' which are in fluid communication with an annular inlet 76'. At the opposite end of housing 70' a radial outlet passage 78' is provided in fluid communication with the internally finned chamber. At the outer periphery of housing 70' is provided an annular passage 80' in fluid communication with an inlet 82' and an outlet 84'. Passage 80' is separate from the internally finned chamber but is in heat exchange relation therewith.

It should be apparent that the working steam enters housing 70' at 76', passes through guide vanes 74', helical fins 72' and exits at outlet 78'. The extracted steam enters at 82' and its condensate exits at 84'. The heating of the working steam (in vortex motion by guide vanes 74') at the periphery of inner surface of the finned chamber creates "buoyant" forces in the radial direction towards the axis which enhances heat transfer thereto and intensifies the vortex motion about the housing axis. Hence, a large radial pressure gradient is produced in the interior of the finned chamber and a mild adverse pressure gradient is produced along the chamber wall. The fins 72' should have a pitch substantially equal to the vortex motion to improve the heat transfer to the working steam and to prevent possible local reverse flow along the interior wall of the chamber.

It should be understood, as used herein, the term "turbine stage" implies also a group of stages, as is well known to those skilled in this art.

Although preferred embodiments of the present invention have been disclosed and described, changes will obviously occur to those skilled in the art. For example, although the systems of FIGS. 1 and 2 and the heat exchangers of FIGS. 3 and 7 offer great advantages in steam power plants, they may be equally employed in systems using working fluids other than steam. Further, although the heat exchangers of FIGS. 3 and 7 have been shown as separate units, they may be combined into a single housing to perform the heating and compression cooling functions. It is, therefore, intended that the present invention is to be limited only by the scope of the appended claims.

What is claimed is:

1. A thermal power plant for reducing exhaust heat and increasing thermal efficiency, comprising:
- a source of working fluid;
- a plurality of interconnected sequentially arranged fluid motor stages;
- a supply conduit for supplying working fluid from said source to the inlet of the first of said stages;
- a conduit from the outlet of the first of said stages for supplying working fluid to the second of said stages;
- additional conduits from the outlet of the second of said stages and from the outlets of each subsequent downstream stage for separately supplying working fluid to the inlet of the next successive downstream stage;
- a plurality of heat exchangers located between said stages for separately extracting heat from the inlet of the immediate upstream stage and separately applying the same to the inlet of the next successive downstream stage; and
- each heat exchanger having at least a pair of inlets and at least a pair of outlets with one of said inlets and one of said outlets being in common fluid communication and in fluid communication, respectively, with the outlet of the immediate upstream stage and with the inlet of the next successive downstream stage, with the other of said inlets being in fluid communication with the inlet of the immediate upstream stage.

2. The thermal power plant according to claim 1, wherein:
- said fluid motors are steam turbines;
- said source of working fluid comprises steam generating means having a feedwater inlet;
- said supply conduit comprises a steam outlet from said steam generating means; and
- the other of each of said heat exchanger outlets being in fluid communication with said feedwater inlet.

3. The thermal power plant according to claim 1, wherein each of said heat exchangers includes:
- a housing; and
- means in said housing for generating a compression flow from one of said inlets to one of said outlets.

4. The thermal power plant according to claim 3, wherein:
- said means comprises a plurality of substantially convergent spaced vanes circularly arrayed about the longitudinal axis of said housing and located at least adjacent to, and in fluid communication with, one of said inlets for providing substantially sprial flow therethrough.

5. The thermal power plant according to claim 4, wherein:
- said means further comprises additional circularly arrayed vanes in axially spaced relation; and there is further provided
- a plurality of spaced annular chambers extending radially from the longitudinal axis of said housing and in surrounding relation to said vanes, with the inner portions of each chamber being in fluid communication with each other upstream of said vanes and the outer peripheral portions of each chamber being in fluid communication with each other.

6. The thermal power plant according to claim 4, further comprising:
- an interior helically finned chamber within said housing in fluid communication with said vanes for providing a vortex flow.

7. The thermal power plant according to claim 6, wherein:
- the pitch of said helically finned chamber is substantially equal to that of said vortex flow.

8. The thermal power plant according to claim 1, further comprising:
- a plurality of additional heat exchangers between said stages, each of which having a first inlet in fluid communication with the outlet working fluid of an immediate upstream stage and a first outlet in fluid communication with one of said inlets of said first-mentioned heat exchangers.

9. The thermal power plant according to claim 8, wherein:
- said fluid motors are steam turbines;
- said source of working fluid comprises steam generating means having a feedwater inlet;
- said supply conduit comprises a steam outlet from said steam generating means;

the other of each of said heat exchanger outlets being in fluid communication with said feedwater inlet;

each of said additional heat exchangers is provided with a second outlet in fluid communication with said feedwater inlet of said steam generating means; and each of said additional heat exchangers is provided with a second inlet in fluid communication with fluid pumped from said feedwater inlet upstream of said stream generating means.

10. The thermal power plant according to claim 8, wherein:

at least one of said first-mentioned heat exchangers and said additional heat exchangers each includes:

a housing; and means in said housing for generating a compression flow from one of said inlets to one of said outlets.

11. The thermal power plant according to claim 10, wherein:

said means comprises a plurality of substantially convergent spaced vanes circularly arrayed about the longitudinal axis of said housing and located at least adjacent to, and in fluid communication with, one of said inlets for providing substantially spiral flow therethrough.

12. The thermal power plant according to claim 11, wherein:

said means further comprises additional circularly arrayed vanes in axially spaced relation; and there is further provided a plurality of spaced annular chambers extending radially from the longitudinal axis of said housing and in surrounding relation to said vanes, with the inner portions of each chamber being in fluid communication with each other upstream of said vanes and the outer peripheral portions of each chamber being in fluid communication with each other.

13. The thermal power plant according to claim 11, further comprising:

an interior helically finned chamber within said housing in fluid communication with said vanes for providing a vortex flow.

14. The thermal power plant according to claim 13, wherein:

the pitch of said helically finned chamber is substantially equal to that of said vortex flow.

* * * * *